United States Patent [19]

Ripl et al.

[11] Patent Number: 4,695,384

[45] Date of Patent: Sep. 22, 1987

[54] METHOD FOR IMPROVING THE PHOSPHORUS ELIMINATION CAPACITY OF A LAKE

[75] Inventors: Wilhelm K. Ripl, Berlin, Fed. Rep. of Germany; Bo L. Verner, Saltsjo Boo, Sweden

[73] Assignee: Atlas Copco Aktiebolag, Nacka, Sweden

[21] Appl. No.: 930,307

[22] Filed: Nov. 13, 1986

[30] Foreign Application Priority Data

Nov. 13, 1985 [SE] Sweden ..... 8505383

[51] Int. Cl.[4] ..... C02F 3/32; C12N 1/12

[52] U.S. Cl. ..... 210/602; 210/747; 210/906; 435/257; 47/1.4

[58] Field of Search ..... 210/602, 906, 747, 170; 435/257; 47/1.4

[56] References Cited

U.S. PATENT DOCUMENTS

| | | | |
|---|---|---|---|
| 3,768,200 | 10/1973 | Klock | 435/257 |
| 4,005,546 | 2/1977 | Oswald | 210/602 |
| 4,209,388 | 6/1980 | De Fraites | 210/170 |
| 4,507,206 | 3/1985 | Hughes | 210/906 |
| 4,536,988 | 8/1985 | Hogen | 47/1.4 |

FOREIGN PATENT DOCUMENTS

| | | | |
|---|---|---|---|
| 0181622 | 5/1986 | European Pat. Off. | 435/257 |
| 36-9126 | of 1961 | Japan | 47/1.4 |
| 51-13160 | 2/1976 | Japan | 210/906 |
| 60-105444 | 6/1985 | Japan | 47/1.4 |

*Primary Examiner*—Benoit Castel

*Attorney, Agent, or Firm*—Eric Y. Munson

[57] ABSTRACT

A method of improving the phosphorus elimination capacity of a lake (11). Flexible wall (16) is extended from the bottom (21) of the lake a substantial distance toward the surface (23) of the lake at the beginning of the vegetation period of the lake to separate the lower parts of a minor portion of the lake from the lower parts of the rest of the lake. Sheets (18) are positioned between an inlet channel (12) and the flexible wall (16) as growth areas for algae. The flexible wall (16) is lowered around the end of the vegetation period to allow the flushing away of sedimented algae from the bottom of the minor portion of the lake.

1 Claim, 5 Drawing Figures

METHOD FOR IMPROVING THE PHOSPHORUS ELIMINATION CAPACITY OF A LAKE

The present invention relates to a method for improving the phosphorus elimination capacity of a lake.

BACKGROUND OF THE INVENTION

According to a prior art effort for elimination of phosphorus a part of the lake is cut off from the rest of the lake only leaving a small outlet. The idea is to achieve sedimentation of phosphorus containing algae in the smaller part of the lake only. However, it has turned out that the results are very moderate.

In many lakes which have received waste water there exists a sediment layer containing lots of phosphorus to a great extent in form of iron phosphate. The entry of waste water into the lake during its vegetation period results in growth of algae, particularly periphytic algae. These algae fall onto the bottom of the lake and provide energy for sulphate reduction through which hydrogen sulphide is formed. This hydrogen sulphide reacts with iron phosphate in the bottom sediment to form phosphorus acid and iron sulphide. If this is allowed to happen the lake will become entrophic or even hypertrophic. The release of phosphate is quite substantial. If 1 kg of algae reaches the bottom sediment about 100 kg of phosphate is released from the sediment.

SUMMARY OF THE INVENTION

The present invention, which is defined in the appended claim, aims at improving the phosphorus elimination capacity of a lake by restricting sedimentation of algae to a minor portion of the lake. This portion is made as small as possible by restricting the treatment to the vegetation period when the influx of water into the lake normally is low so that the water detention time is long. Another advantage is that the phosphorus loads in tributaries normally are much lower during the vegetation period. Around the end of the vegetation period sedimented material is allowed to be flushed away from the bottom of the minor portion. The invention takes advantage of the above mentioned phenomena and uses the high nitrogen-phosphorus ratio in the incoming water together with the coupled mechanisms between the external and internal phosphorus loadings. The feedback coupling depends on alagae produced in the very beginning of the vegetation period. These algae, after a short period, will load and activate the sediment surface oxidized during the winter period, thereby starting the internal release of phosphorus.

With the present invention production and sedimentation of algae out in the lake are largely restricted thus relieving the sediment surface from degradable organic matter. Reduced internal phosphorus release is thereby achieved. The high nitrogen-phosphorus ratio and long water detention time favour easily sedimentable green algae and diatoms. The degradation of these algae at the bottom is favoured by denitrification. The fixation of phosphorus in the sediment is mediated by excessive iron flushed into the lake from the inlet channel. It is unlikely that sulphide containing sediment comprising phosphorus recycling should build up.

When dimensioning a plant according to the invention it is desirable to strive for a water detention time of 3–10 days. This is sufficient for the treatment and gives high production relative to the volume used for the treatment. It is sufficient to have a water depth of 1.5–4.0 meters for the installation. Only a minor portion of the lake is used and only a few floats are visible on the water surface.

BRIEF DESCRIPTION OF THE DRAWING

An embodiment of the invention is described below with reference to the accompanying drawings in which.

DESCRIPTION OF THE PREFERRED EMBODIMENT

Figure 1:
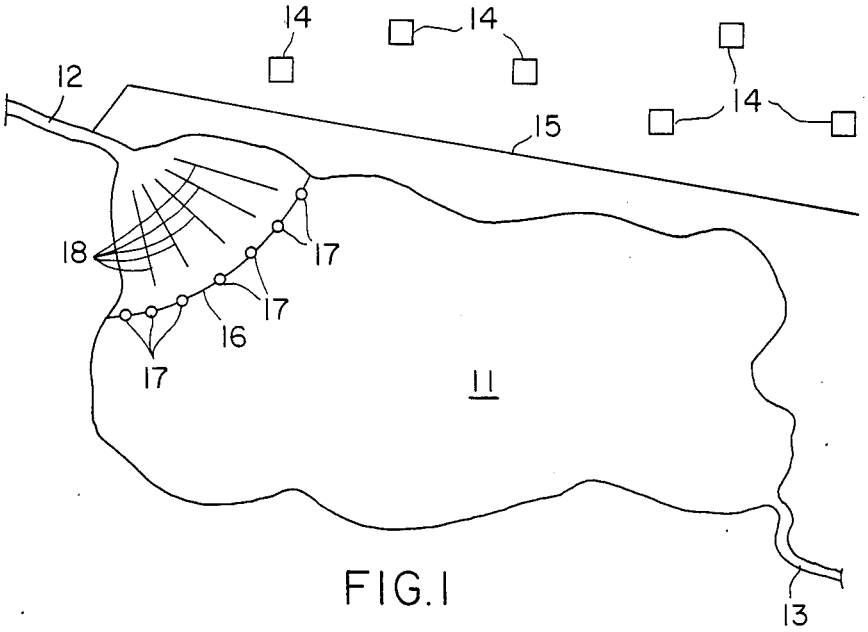
FIG. 1 shows a plan view of a lake where the invention is used.
Figure 2:
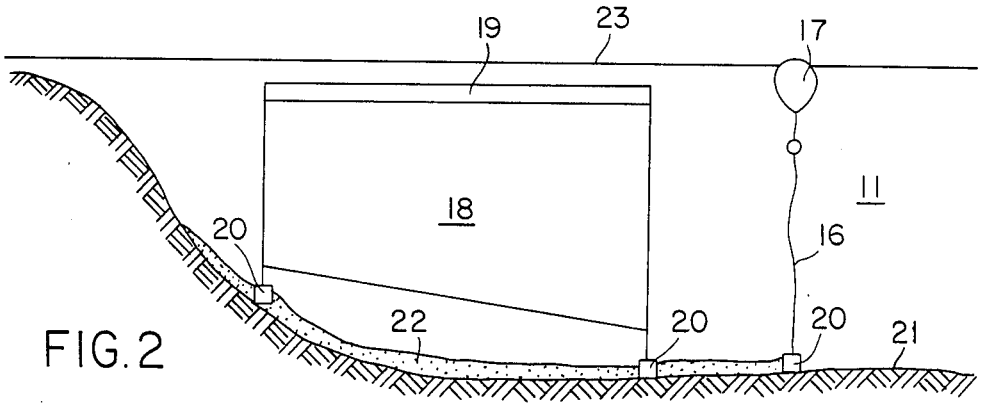
FIG. 2 shows a vertical section through the lake.
Figure 3:
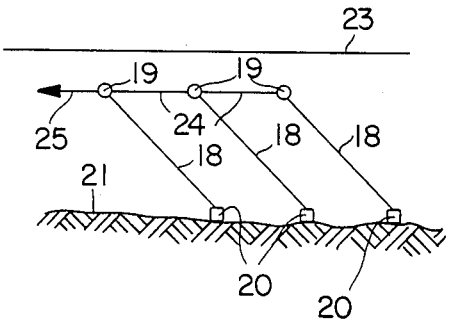
FIG. 3 shows a part section seen from the right in FIG. 2.

The embodiment of the invention shown in FIGS. 1–3 is used in a lake 11 having an inlet channel 12 and an outlet channel 13. Near the lake there is an urban area represented by houses 14. Phosphorus containing water from the urban area is collected in a diversion pipe 15 and drained to the inlet channel 12. A flexible wall 16 is provided between the bottom 21 of the lake and a level somewhat below the water surface 23. The flexible wall is thus extending from the bottom a substantial distance toward the surface. A number of floats 17 keep the flexible wall in vertical position. The flexible wall is extended to the shown position at the beginning of the vegetation period of the lake. The flexible wall extends from shore to shore on either side of the inlet channel 12. The water volumes on the two sides of the flexible wall are connected with one another via a channel between the upper limit of the flexible wall and the water surface. This channel extends over the entire width of the flexible wall which allows the water coming through channel 12 to pass the flexible wall at a very low velocity after having been detained to the left of the flexible wall for phosphorus elimination. A number of sheets 18 are arranged between the inlet channel 12 and the flexible wall at substantially right angles to the flexible wall. Flexible wall 16 and sheets 18 are anchored on the bottom 21 by means of weights 20. Sheets 18 are provided with float elements 19. As shown in FIG. 3 the sheets 18 can advantageously be interconnected by strings 24 and exerted to a force 25 so that sheets 18 become inclined relative to a vertical plane through the upper limit lines 19 of the sheets. Sheets 18 are provided as growth areas for algae, in particular periphytic algae. By inclining sheets 18 sedimentation kinetics is enhanced. Sedimenting algae can fall from one sheet onto the next lower sheet from which they can roll down to sediment layer 22. During periods of high waterflow or ice formation the equipment can easily be lowered to the bottom. The flexible wall is lowered around the end of the vegetation period of the lake to allow the flushing away of sedimented algae from the bottom of the minor portion of the lake to the left of the flexible wall 16. The lowering of the flexible wall does not have to take place exactly at the end of the vegetation period even though lowering of the flexible wall substantially before the end of the vegetation period decreases the efficiency of the method. It is possible to further increase the efficiency of the invention by biomanipulation of the food web and by fish hatching in net cages with fish biomass adjusted to zooplankton density. Sheets 18 should be arranged such that equal water flows are obtained in the different channels defined by the sheets.

Figure 4:
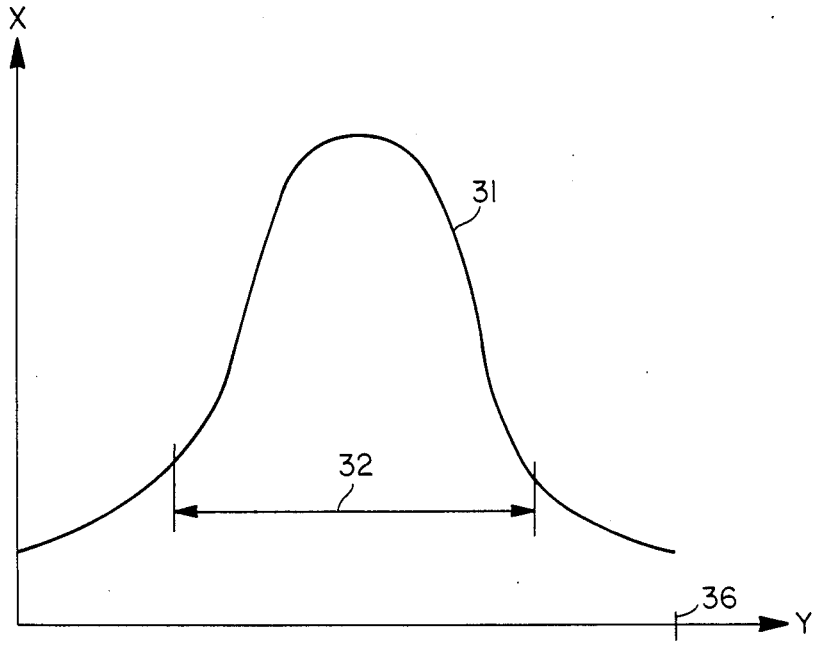
FIG. 4 shows an example of how the water detention time varies over one year.

In FIG. 4 curve 31 shows how the water detention time varies over one year. The horizontal axis starts with the beginning of the year. Line 36 marks the end of the year. Line 32 marks the extension of the vegetation period.

Figure 5:
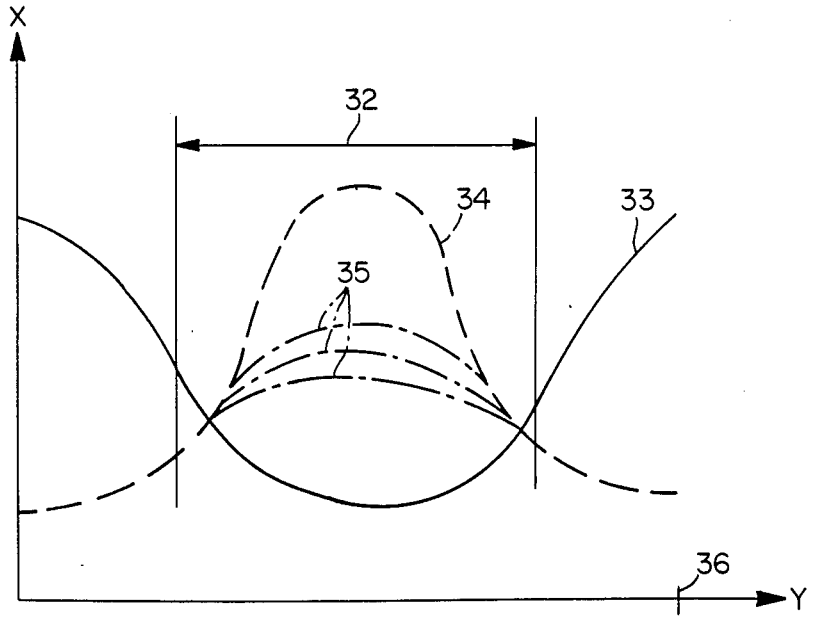
FIG. 5 shows an example of how the external inflow of phosphorus and the release of phosphorus from the bottom sediment vary over one year.

FIG. 5 shows how the phosphorus load varies over the year. The horizontal scale is the same as in FIG. 4 with the same vegetation period 32. Curve 33 shows how the external phosphorus load, i.e. the amount of phosphorus coming through inlet channel 12, varies over one year. Curve 34 shows how the internal phosphorus load, i.e. the amount of phosphorus released from bottom sediment 22, varies over one year. The treatment with the device according to the invention results in a successively decreasing internal phosphorus load as indicated by the curves 35.

We claim:

1. A method of improving the phosphorus elimination capacity of a lake (11) by restricting sedimentation of algae to a minor portion of the lake which comprises; extending a flexidle wall (16) from the bottom (21) of the lake (11) a substantial distance toward the surface (23) of the lake and between the boundaries of the lake on either side of an inlet channel (12) at the beginning of the vegetation period of the lake to separate the lower parts of a minor portion of the lake from the lower parts of the rest of the lake, positioning a number of sheets (18) between the inlet channel (12) and the flexible wall (16) as growth areas for algae, feeding phosphorus containing water to said inlet channel, and lowering the flexible wall (16) around the end of the vegetation period of the lake to allow the flushing away of sedimented algae from the bottom of said minor portion.

* * * * *